US006902382B2

(12) United States Patent
Christensen et al.

(10) Patent No.: US 6,902,382 B2
(45) Date of Patent: Jun. 7, 2005

(54) GEAR MOTOR START UP CONTROL

(76) Inventors: Matthew Peter Christensen, 891 Riverside Rd., Belvidere, IL (US) 61008; Larry Anderson, 1578 Saratoga La., Rockford, IL (US) 61107; George Kadlicko, 2610 Cerro Vista Dr., Rockford, IL (US) 61107

( * ) Notice: Subject to any disclaimer, the term of this patent is extended or adjusted under 35 U.S.C. 154(b) by 0 days.

(21) Appl. No.: 10/659,704

(22) Filed: Sep. 11, 2003

(65) Prior Publication Data

US 2005/0058566 A1 Mar. 17, 2005

(51) Int. Cl.[7] ..... F01C 1/18
(52) U.S. Cl. ..... 418/206.1; 418/206.6; 418/206.7; 418/149; 418/132
(58) Field of Search ..... 418/206.1, 206.6, 418/206.7, 149, 132, 133

(56) References Cited

U.S. PATENT DOCUMENTS 3,830,602 A * 8/1974 Boop et al. ..... 418/131
3,961,872 A * 6/1976 Muller et al. ..... 418/132
4,038,000 A * 7/1977 Dworak ..... 418/206.3
4,124,335 A * 11/1978 Jons et al. ..... 418/132
4,527,966 A * 7/1985 Laumont ..... 418/132

* cited by examiner

*Primary Examiner*—Thomas Denion
*Assistant Examiner*—Theresa Trieu

(57) ABSTRACT

A hydraulic motor comprising a housing having a fluid inlet. A fluid outlet and a cavity there between, a pair of intermeshing gear elements rotatable in the housing about mutually parallel axes. Each of the gear elements having a set of gear teeth disposed about the periphery of the element and a support shaft extending from oppositely directed end faces of the set of gear teeth. A bearing assembly located on opposite sides of the cavity in said housing to support the shafts for rotation about respective ones of the axes. Each of the bearing assemblies having a sealing face overlying the end faces and biased into engage with the end faced by a pressure compensating seal located between the bearing and the housing. The sealing face having a channel extending partially about the spindle and in fluid communication with the inlet to introduce fluid under pressure between the faces.

10 Claims, 4 Drawing Sheets

GEAR MOTOR START UP CONTROL

BACKGROUND OF THE INVENTION

The present invention relates to hydraulic motors.

1. Field of the Invention

Hydraulic motors are well known for converting fluid energy into mechanical energy in a system. Hydraulic motors may comprise a number of different basic configurations but a widely used type of motor is one known as a gear motor. A gear motor uses a pair of intermeshing gear elements rotating within a housing. High pressure fluid delivered to an inlet induces rotation of the gear elements and causes a corresponding rotation of a shaft connected to one of the gear elements. Such motors are relatively inexpensive and are capable of handling relatively high pressures.

2. Summary of the Invention

To improve the efficiency of the motor, the end faces of the gear sets are sealed with a pressure compensating seal assembly in which the pressure of the fluid delivered to the inlet is applied to the seal to ensure close contact with the end faces. Whilst this arrangement improves the efficiency of the motor in use, it can lead to difficulties in initial starting of the motor. The high contact force provided by the pressure compensated seal inhibits rotation of the motor, particularly where the motor is connected to high inertia loads such as a cooling fan or mower reel.

3. Description of the Prior Art

It is accordingly an object of the present invention to provide a motor which the above disadvantages are obviated or mitigated.

In general terms, the present invention provides a gear type hydraulic motor in which pressure fluid is introduced in discrete areas between the gear faces and a pressure compensated seal to improve lubrication upon start up.

According therefore to the present invention there is provided a hydraulic motor comprising a housing having a fluid inlet, a fluid outlet and a cavity therebetween. A pair of intermeshing gear elements are rotatable in the housing about mutually parallel axes. Each of the gear elements have a set of gear teeth disposed about the periphery of the element and a support shaft extending from oppositely directed end faces of the set of gear teeth. A bearing assembly is located on opposite sides of the cavity in the housing to support the shafts for rotation about respective ones of the axes. Each of the bearing assemblies has a sealing face overlying the end faces and biased into engagement with the end faces by a pressure compensating seal located between the bearing and the housing. The sealing face has a channel extending partially about the shaft and a fluid communication with the inlet to introduce fluid under pressure between the faces.

BRIEF DESCRIPTION OF THE DRAWINGS

An embodiment of the invention will now be described by way of example only with reference to the accompanying drawings in which.

DESCRIPTION OF THE PREFERRED EMBODIMENTS

Figure 1:
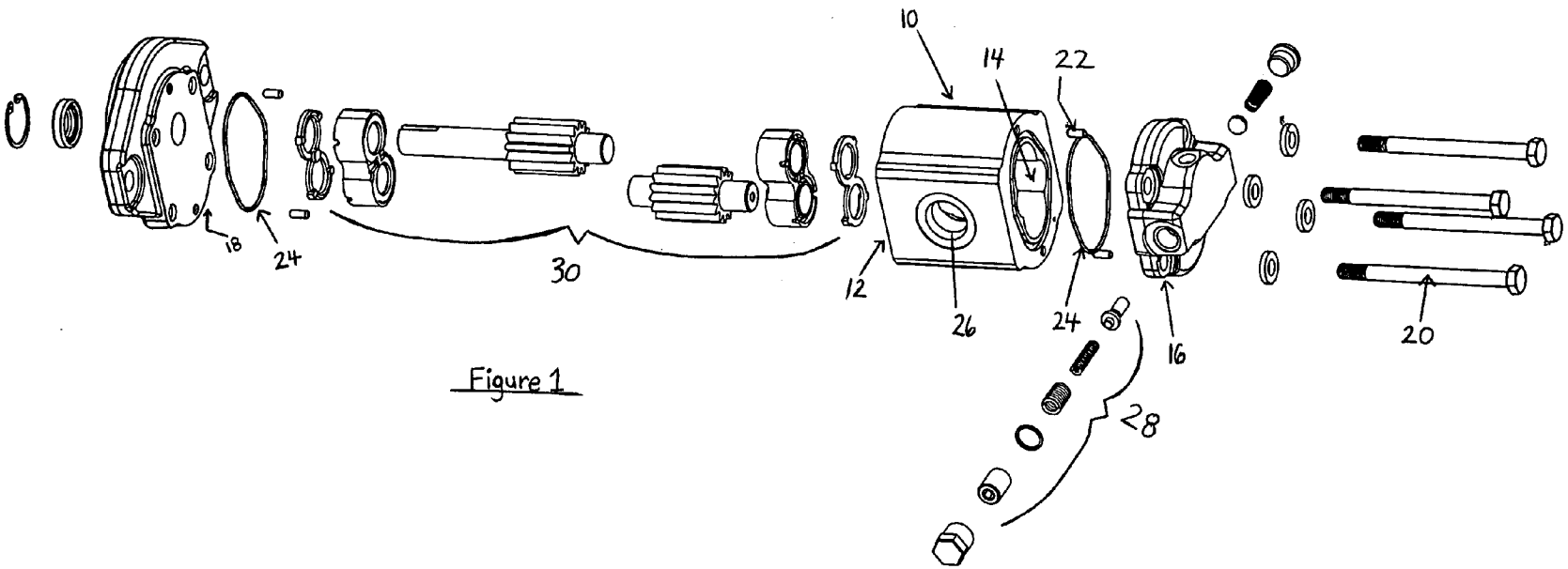
FIG. 1 is an exploded perspective view of a hydraulic motor.

Referring therefore to FIG. 1, a hydraulic motor generally indicated 10 has a body 12 with an internal cavity 14. A pair of end caps 16, 18 are connected to the housing 12 through bolts 20 and pins 22. A seal 24 between the end caps 16, 18 and housing 12 provides a hydraulically sealed unit.

Figure 3:
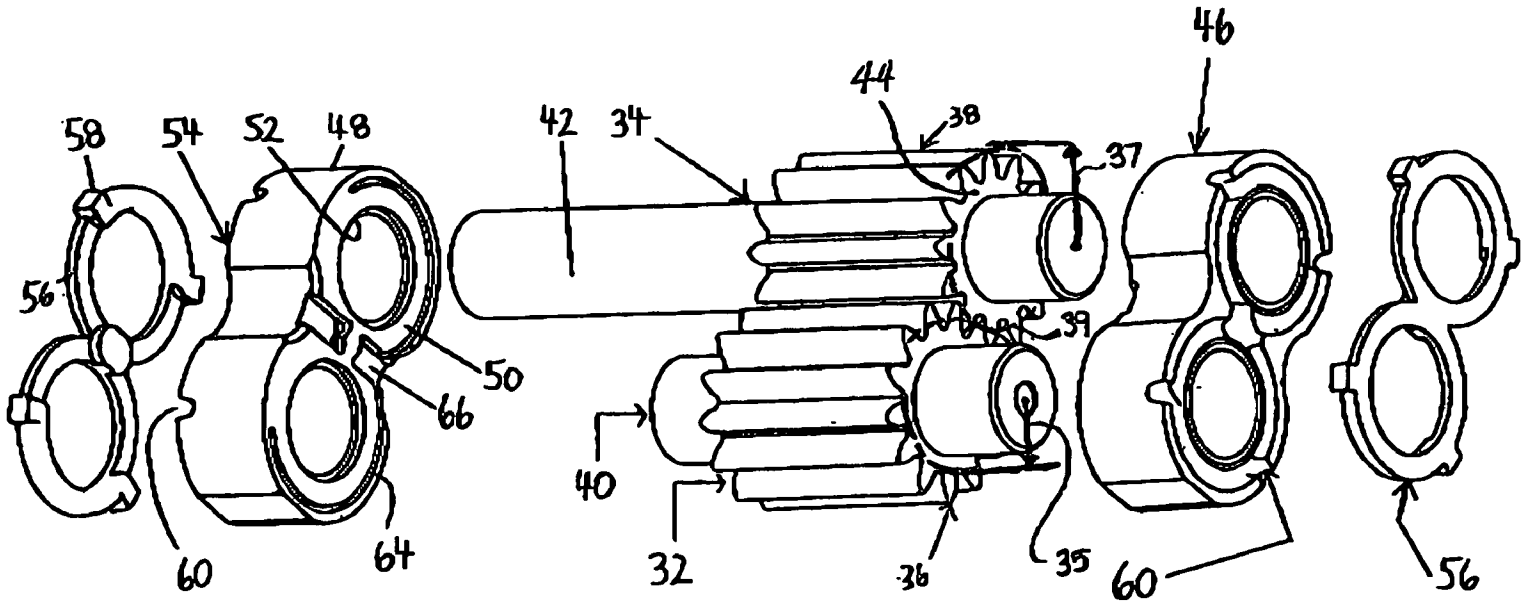
FIG. 3 is a perspective view on an enlarged scale showing the bearing and seal assemblies of the motor.

Fluid is introduced into the cavity 14 through an inlet 26 and flows out of the cavity through a similar outlet duct 27 (FIG. 4) on the opposite wall. End cap 16 also houses a pressure relief valve assembly 28 to avoid excess pressure in the cavity 14. The cavity 14 houses motor elements collectively indicated at 30. The motor elements are best seen in FIG. 3 and comprise a pair of gear elements 32, 34. Each of the gear elements has a set of gear teeth 36, 38 disposed about respective shafts 40, 42. The sets of gear teeth 36, 38 have radial extending end faces 44.

The shafts 40, 42 are supported at opposite ends in bearing 46, 48. Each of the bearings 46, 48 is similar and has a planar end face 50 arranged opposite the end faces 44. The shafts 40, 42 are received in respective cylindrical bores 52 and the bearings are a sliding fit in the respective end caps 16, 18. The oppositely directed face 54 of the bearings 46, 48 supports a pressure compensating seal assembly 56. The seal assembly 56 has tangs 58 located in notches 60 on the bearing to maintain it in position.

Figure 2:
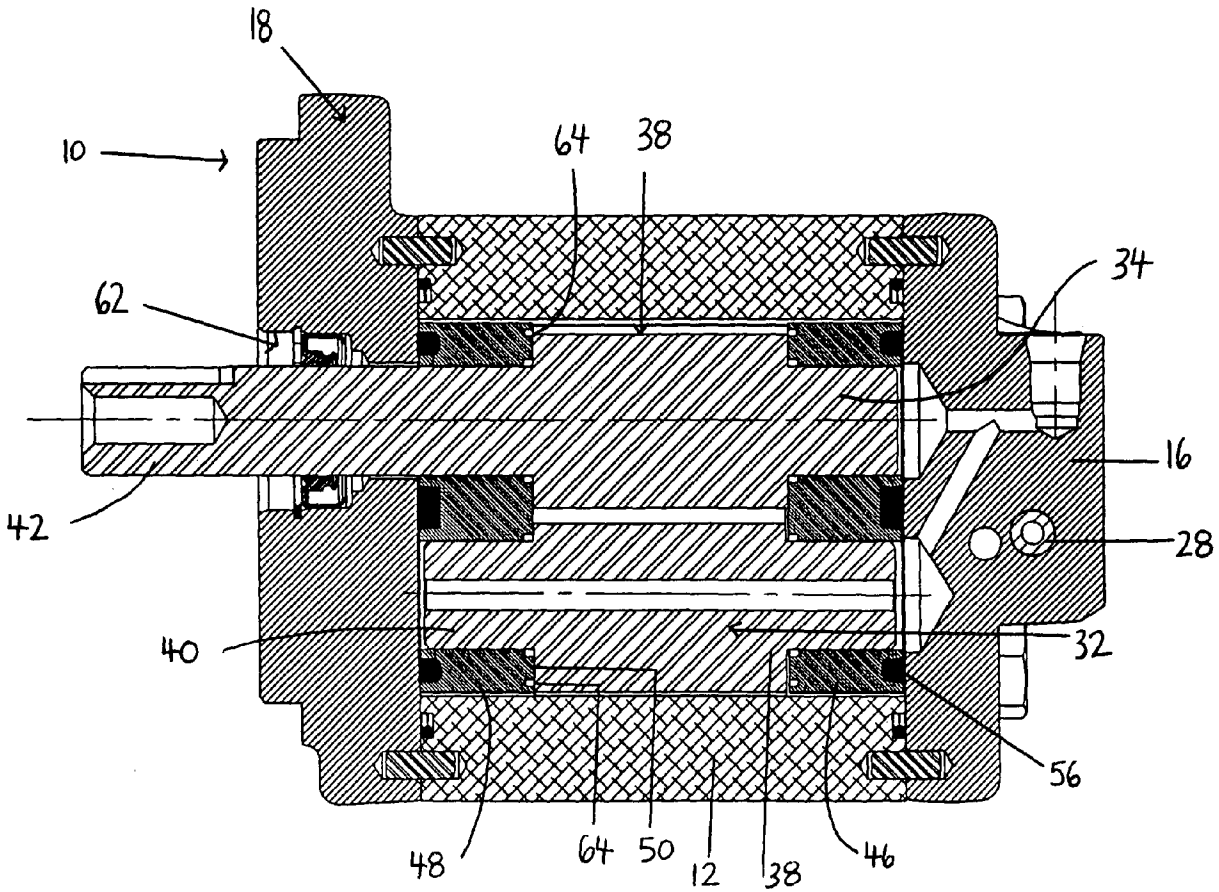
FIG. 2 is a view on the line 2—2 of FIG. 1.

As can better be seen in FIG. 2, the seal 56 and bearings 46, 48 are located within the cavity 14 so that the sets of gear teeth 36, 38 are inter-engaged for conjoint rotation. One end of the shaft 42 projects through a bore in the end cap 18 and is sealed by a shaft seal 62.

Figure 4:
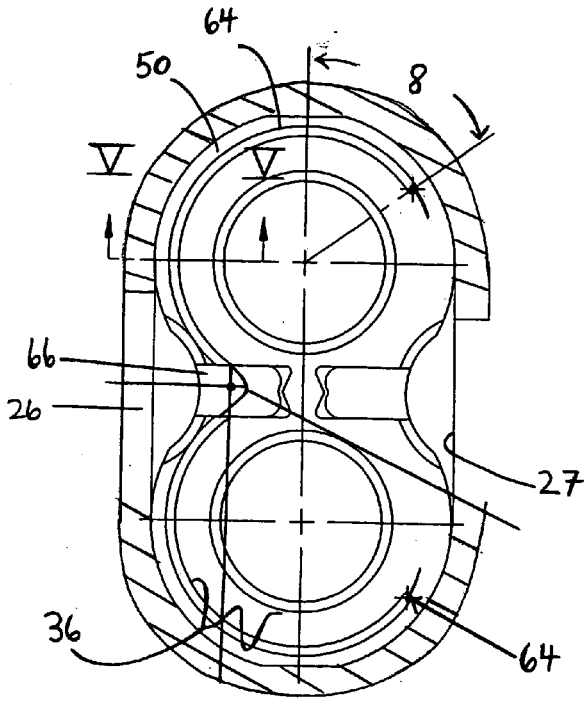
FIG. 4 is an end view of a bearing block shown in FIG. 3.

Referring once more to FIG. 3, and to FIG. 4, the end face 50 of each of the bearings is formed with a channel 64 that extends from a groove 66 in opposite directions about each of the shafts 40, 42. The groove 66 opens onto the high pressure side of the motor 10, that is in fluid communication with the inlet 26, and the channel 64 extends partially about the shaft and terminates prior to the lower pressure zone adjacent the outlet 27. In the preferred embodiment, the channel 64 is located between the root diameter 35 and major diameter 37 of the tooth and in the embodiment shown is centered on the pitch circle 39 of the gear sets 36, 38 so as to be partially covered by each tooth of the gear. The channel 64 extends over an arc in the order of 165° to 220° although in general, the arc should extend sufficiently about the shaft to terminate just prior to the connection of fluid contained within adjacent gear teeth with the low pressure zone hydraulically connected to the outlet. In one embodiment, the channel 64 extends 55° beyond a line joining the centres of rotation of the shafts 40, 42, indicated by the arc in FIG. 4 so as to terminate prior to the point at which the housing and gear teeth separate adjacent the outlet 27. The width of channel 64 is selected to provide sufficient area to counter balance the forces imposed by the pressure compensated seal 56 and, in a particular embodiment tested, a width of between 0.8 mm and 1.1 mm extending on a radius between 12.7 mm and 13.0 mm over an arc of 220° measured from the root of the grove 66 provided a effective surface area of 74 $mm^2$. The depth of the channel 64 was 1.5 to 1.0 mm.

In operation, high pressure fluid is introduced into the inlet 26 and, through action on the gear sets 36, 38 causes rotation in opposite direction of the shafts 40, 42. Fluid from the inlets is delivered to the pressure compensating seal assembly that biases the bearings 46, 48 toward the end faces 44 of the gear sets 36, 38. Pressure fluid is also delivered to the notch 66 and carried in the channel 64 about the shaft to counter the force of the pressure compensating seal. The channel 64 also permits lubricant to flow between the end faces 44 and the face 50 of the bearing and provide lubrication in a controlled manner to the end faces. Accordingly, upon start up of the motor 10, the clamping force induced by the seal 56 on the end faces 44 is reduced by the force exerted from fluid in the channel 64 and the presence of lubricant at the end faces.

Figure 5:
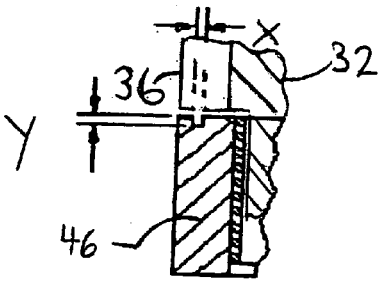
FIG. 5 is a view on the line V—V of FIG. 4.

As may be seen from FIGS. 4 and 5, the location of the channel 64 between the root diameter 35 and major diameter 37 of the tooth permits the fluid to flow between the faces of the teeth 36, 38 and the end face 50 to provide lubrication to each of the teeth 36, 38. A location on the pitch circle 39 diameter has been used in testing.

In testing conducted with a motor having a capacity of, A, it was found that the starting torque was decreased by 15% to 29% with a channel 64 of the dimensions detailed above. It will be seen therefore that by providing the channel 64 in the end faces of the bearings 46, 48 start up of the motors is facilitated.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A hydraulic motor comprising a housing having a fluid inlet, a fluid outlet and a cavity there between, a pair of intermeshing gear elements rotatable in said cavity about mutually parallel axes, each of said gear elements having a set of gear teeth disposed about the periphery of said element and a support shaft extending from oppositely directed end faces of said set of gear teeth, a bearing assembly located on opposite sides of said cavity in said housing to support said shafts for rotation about respective ones of said axes, each of said bearing assemblies having a sealing face overlying said end faces and biased into engagement with said end face by a pressure compensating seal located between the oppositely directed surfaces of said bearing and said housing, said sealing face having a channel extending partially about said shaft and in fluid communication with said inlet to introduce fluid under pressure between said sealing face and said end faces of said gear teeth.

2. A motor according to claim 1 wherein said channel is accuate and is centered on said axis of rotation.

3. A motor according to claim 2 wherein said channel is located between a root diameter and major diameter of each gear teeth.

4. A motor according to claim 3 wherein said channel is located on a pitch circle of gear teeth.

5. A motor according to claim 1 wherein said bearing assembly is integrally formed to support both of said shafts and a pair of channels extend about respective ones of said gears.

6. A motor according to claim 5 wherein said channels intersect at said inlet.

7. A motor according to claim 6 wherein said channels are located between a root diameter and major diameter of said teeth.

8. A motor according to claim 7 wherein said channels are located on the pitch circle of said teeth.

9. A motor according to claim 6 wherein said channels extend over an arc of 180°.

10. A motor according to claim 9 wherein said channels extend over an arc of 165°.

* * * * *